US008479735B2

(12) United States Patent
Narciso

(10) Patent No.: US 8,479,735 B2
(45) Date of Patent: Jul. 9, 2013

(54) NASAL CAVITY FILTER

(76) Inventor: Paolo Narciso, Rome (IT)

( * ) Notice: Subject to any disclaimer, the term of this patent is extended or adjusted under 35 U.S.C. 154(b) by 720 days.

(21) Appl. No.: 12/451,875

(22) PCT Filed: May 14, 2007

(86) PCT No.: PCT/IT2007/000346

§ 371 (c)(1),
(2), (4) Date: Feb. 23, 2010

(87) PCT Pub. No.: WO2008/139499

PCT Pub. Date: Nov. 20, 2008

(65) Prior Publication Data

US 2010/0147307 A1 Jun. 17, 2010

(51) Int. Cl.
*A61G 10/00* (2006.01)

(52) U.S. Cl.
USPC ..... 128/206.11; 128/205.27

(58) Field of Classification Search
USPC ..... 128/206.11
See application file for complete search history.

(56) References Cited

U.S. PATENT DOCUMENTS

| | | | | |
|---|---|---|---|---|
| 4,267,831 | A | 5/1981 | Aguilar | |
| 4,402,317 | A | 9/1983 | Martin | |
| 5,392,773 | A | 2/1995 | Bertrand | |
| 5,787,884 | A * | 8/1998 | Tovey | 128/206.11 |
| 2003/0106556 | A1 * | 6/2003 | Alperovich et al. | 128/206.11 |
| 2006/0144398 | A1 * | 7/2006 | Doshi et al. | 128/204.23 |

FOREIGN PATENT DOCUMENTS

| | | | |
|---|---|---|---|
| FR | 2 691 365 | A | 11/1993 |
| FR | 2 707 884 | A | 1/1995 |
| WO | WO01/41629 | A | 6/2001 |
| WO | WO01/62342 | A | 8/2001 |

OTHER PUBLICATIONS

PCT Search Report Dated Jan. 29, 2008.

* cited by examiner

*Primary Examiner* — Nicholas Lucchesi
*Assistant Examiner* — Leah Stohr
(74) *Attorney, Agent, or Firm* — Hedman & Costigan, P.C.; James V. Costigan

(57) ABSTRACT

A nasal cavity filter (2) having a substantially cylindrical supporting wall (4), which adheres to the walls of a nasal cavity, and an inner surface (5) of which defines a cavity (6) for the passage of air inhaled and exhaled by the user. The cavity (6) houses a number of fins (7), which generate turbulence in the air flowing through, and the surface of which impacted by the air retains particles present in the air.

9 Claims, 1 Drawing Sheet

NASAL CAVITY FILTER

TECHNICAL FIELD

The present invention relates to a nasal cavity filter.

More specifically, the filter according to the present invention is disposable, and provides mainly for protecting the respiratory tracts from atmospheric pollution.

BACKGROUND ART

As is known, concern has repeatedly been expressed regarding the harmful effects of air pollution, of which concentrations of sulphur dioxide and fine powder in industry and transport, and pollution by carbon monoxide, ozone, and benzene are among the major threats to human health.

Scientific research leaves no doubt as to the close relationship between the concentration of these pollutants in air and the occurrence of respiratory diseases.

At present, the market offers no comfortable, easy-to-use products designed to combat or at least partly solve the problem.

DISCLOSURES OF INVENTION

It is an object of the present invention to provide a device designed to prevent inhalation of harmful particles present in air.

According to the present invention, there is provided a nasal cavity filter as claimed in the accompanying Claims.

BRIEF DESCRIPTION OF THE DRAWINGS

A non-limiting embodiment of the invention will be described by way of example with reference to the accompanying drawings, in which.

BEST MODE FOR CARRYING OUT THE INVENTION

Figure 1:
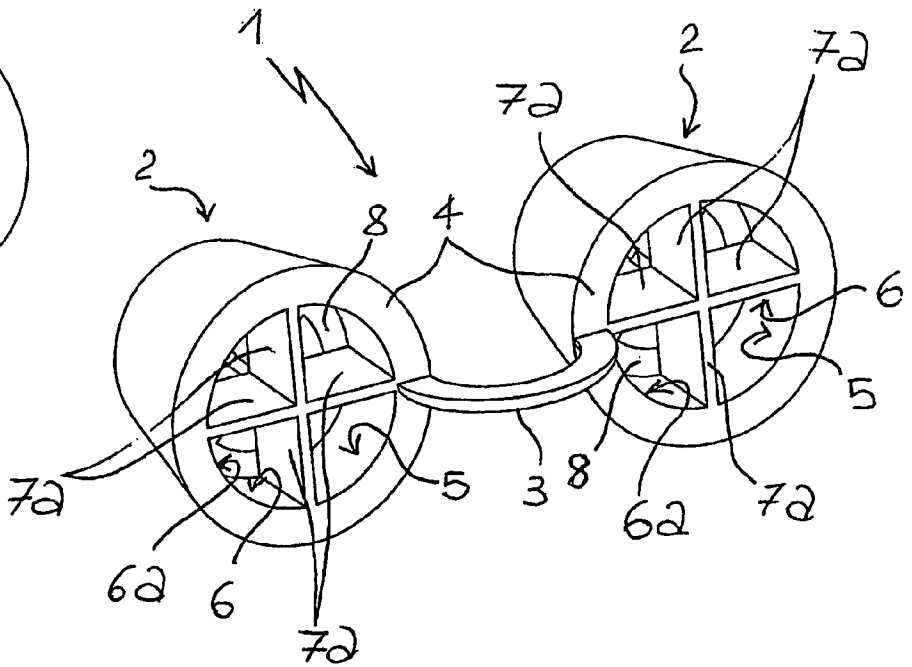
FIG. 1 shows a view in perspective of a preferred embodiment of a device comprising two filters in accordance with the present invention.
Figure 2:
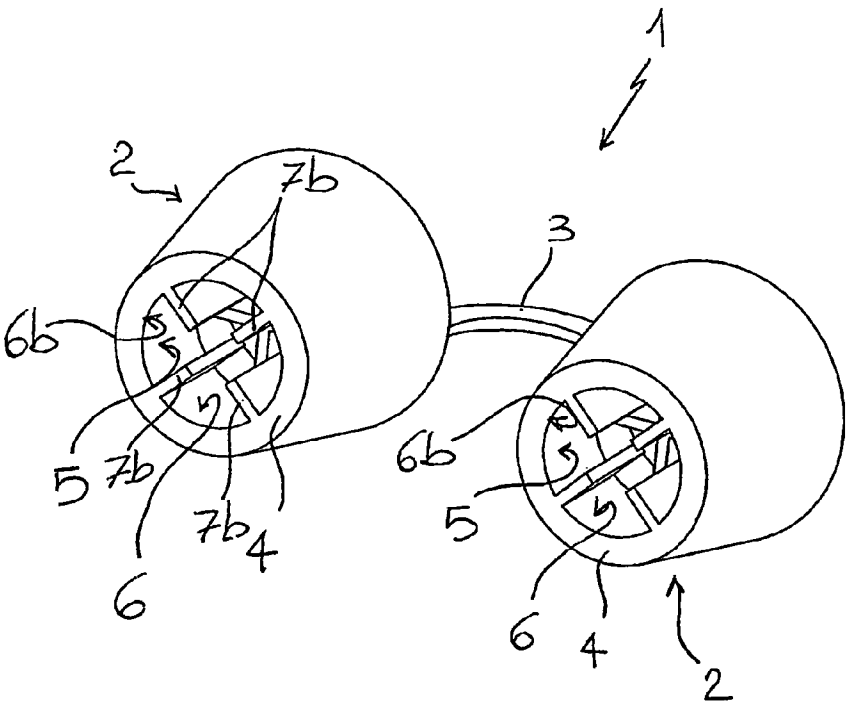
FIG. 2 shows a further view in perspective of the FIG. 1 device.

Number 1 in FIGS. 1 and 2 indicates as a whole a nasal cavity filter device comprising two filters 2 in accordance with the present invention; and a connecting member 3 positioned, in use, in front of the nasal septum. Each filter 2 is housed, in use, inside a respective nostril, and connecting member 3 serves to prevent overly forceful insertion of filters 2 inside the nostrils, and easy withdrawal of filters 2 from the nostrils.

Each filter 2 comprises a supporting wall 4, which is truncated-cone-shaped to adapt to the nasal cavity, and an inner surface 5 of which defines a through cavity 6, through which the air inhaled and exhaled by the user flows in use.

Each filter 2 comprises a number of fins 7 extending from inner surface 5 of supporting wall 4 and housed longitudinally inside cavity 6. More specifically, each filter 2 comprises a first group of four fins 7*a* joined in the form of a cross and located close to a large-diameter opening 6*a* of cavity 6; and a second group of four fins 7*b*, which are separate and converge with one another, are offset 45° with respect to the group of fins 7*a*, and are located close to a small-diameter opening 6*b* of cavity 6. A shoulder 8 is formed on inner surface 5, between the first group of fins 7*a* and the second group of fins 7*b*, and facing the large-diameter opening 6*a*.

A number of surfaces are thus formed inside cavity 6, which generate turbulence in the inhaled airflow and, hence, an extensive impact area of the inhaled air on the surfaces.

Fins 7 are preferably molded from polymer material in one piece with supporting wall 4.

Supporting wall 4 and fins 7 are made of soft material, such as latex, alimentary silicone or medical silicone, and are optionally covered with outer material, such as paper, rubber-coated paper, silk, cotton, sponge, teased silk, or hypoallergenic plastic. Supporting wall 4 is of soft consistency to adhere perfectly to the nasal cavity and so ensure perfect sealing and firm seating, unaffected by inhalation and exhalation, inside the nasal cavity.

Supporting wall 4 is designed to adapt to the nasal pyramid with no impairment in operation of the sebaceous glands, or in respiratory, olfactory or phonatory functions.

All the surfaces inside cavity 6 are preferably coated with water-base gel. In a further preferred embodiment, the gel is charged electrostatically, so that particles in the inhaled air are retained by viscosity as well as electrostatically.

The water-base gel may comprise one or more excipients from the group comprising: thymol, essential oils of various woods, essential oil of myristica, white Vaseline, lanolin, hydrogenated fatty acid triglycerides, glycerine, polyethylene glycols, and starch; and one or more active principles from the group comprising: camphor, essential oil of turpentine, menthol, essential oil of eucalyptus, kaolin, and bentonite.

In one particular embodiment, the filter according to the present invention may comprise a transverse filter comprising absorbent materials, such as active carbon, to more effectively retain gas-carried aerosol substances.

As will be clear from the above description, the device according to the present invention is highly straightforward and reliable, by combining the formation of turbulence in the inhaled air with an extensive impact area of the inhaled air on the particle retaining surfaces.

The electrostatic gel, in particular, provides for effective particle retention by combining the electrostatic effect and viscosity of the gel.

Clearly, the materials and designs, particularly of fins 7, may differ from those described, provided they ensure turbulent airflow through cavity 6 and particle retention performance in accordance with the present invention.

It should be pointed out that, in addition to pollution protection, the filter according to the present invention may also be used for medical and surgical purposes, by also employing homeopathic and/or allopathic substances.

The invention claimed is:

1. A nasal cavity filter (2) comprising a substantially cylindrical supporting wall (4), which adheres to the walls of a nasal cavity, and an inner surface (5) of which defines a cavity (6) for the passage of air inhaled and exhaled by the user; said filter (2) comprising a number of fins (7), which are housed inside said cavity (6), generating turbulence in the air flowing through, and the surface of which impacted by the air retains particles present in the air said filter (2) being characterised in that it comprises a layer of gel covering said inner surface (5) and said fins (7) wherein said supporting wall 4 has a truncated-cone-shape and said fins (7) comprise a first group of four fins (7*a*) joined in the form of a cross and said fins are located close to a large-diameter opening (6*a*) of said cavity (6) and a second group of four fins (7*b*) which are separated and converged with one another and are offset 45° with respect to said first group of fins (7*a*), and said second group of fins (7*b*) are located close to a small-diameter opening (6*b*) on said cavity (6).

2. A nasal cavity filter (2) as claimed in claim 1, characterised in that said gel is water-based and charged electrostatically.

3. A nasal cavity filter (2) as claimed in claim 1 characterised in that said gel comprises one or more excipients from the group comprising: thymol, essential oils of the various woods, essential oils myristica, white Vaseline, lanolin, hydrogenated fatty acid triglycerides, glycerine, polyethylene glycols, and starch; and one or more active principles from the group comprising: camphor, essential oil of turpentine, menthol, essential oil of eucalyptus, kaolin, and bentonite.

4. A nasal cavity filter (2) as claimed in claim 1, characterised in that said fins (7) extends from said inner surface of said supporting wall (4), and are positioned longitudinally with respect to the supporting wall (4).

5. A nasal cavity filter (2) as claimed in claim 4, characterised in that said fins (7) are formed in one piece with said supporting wall (4).

6. A nasal cavity filter (2) as claimed in claim 1, characterized in that said supporting wall is made of a material from the group comprising latex, alimentary silicone, and medical silicone.

7. A nasal cavity filter (2) as claimed in claim 1, characterized in that said supporting wall (4) is truncated-cone-shaped.

8. A nasal cavity filter (2) as claimed in claim 1, characterized in that a shoulder (8) is formed on the inner surface (5), is located between the first group of fins (7*a*) and the second group of fins (7*b*), and faces the large-diameter opening (6*a*).

9. A nasal cavity filter device (1), characterized by comprising two nasal filters (2) as claimed in claim 1, and a connecting member (3) extending between the two filters (2).

* * * * *